US006157005A

United States Patent [19]

Lu

[11] Patent Number: 6,157,005

[45] Date of Patent: Dec. 5, 2000

[54] DRY-HEAT SAUNA MACHINE

[76] Inventor: Shun-Tsung Lu, No. 160-2, Sec. 2, Fu Hsing Rd., Taichung, Taiwan

[21] Appl. No.: 09/386,118

[22] Filed: Aug. 30, 1999

[51] Int. Cl.[7] ..... A61H 33/06

[52] U.S. Cl. ..... 219/400; 4/531

[58] Field of Search ..... 219/400; 4/528, 4/531, 532; 607/81

[56] References Cited

U.S. PATENT DOCUMENTS

| | | | |
|---|---|---|---|
| 1,694,858 | 12/1928 | Landon | 219/400 |
| 2,406,222 | 8/1946 | Howard | 4/532 |
| 3,875,596 | 4/1975 | Noda | 4/532 |
| 4,031,573 | 6/1977 | Romanoff | 4/532 |
| 4,671,284 | 6/1987 | Wilson et al. | 607/81 |
| 4,712,538 | 12/1987 | Hardie et al. | 4/524 |
| 4,862,526 | 9/1989 | Berger | 4/531 |
| 4,884,574 | 12/1989 | Hardie et al. | 4/529 |
| 5,101,809 | 4/1992 | Daffer et al. | 607/82 |
| 5,546,678 | 8/1996 | Dhaemers | 4/524 |
| 5,645,578 | 7/1997 | Daffer et al. | 607/91 |
| 5,891,186 | 4/1999 | Daffer et al. | 607/91 |
| 5,950,254 | 9/1999 | Yasue | 4/524 |

*Primary Examiner*—Joseph Pelham
*Attorney, Agent, or Firm*—Alaw Kamrath

[57] ABSTRACT

A dry-heat sauna machine includes a frame having a vertical portion and a horizontal portion. A cloth cover covers the fame to form a sauna enclosure. An air-circulating device is attached to the horizontal portion of the frame. A programmer is attached to the sidewall of the frame. The air-circulating device includes a compressor attached to the horizontal portion of the frame and a partition covering the compressor to define a control chamber between the seat and the partition. A condenser, a heating element and a fan are all attached to said partition and received in the control chamber. The hot air is blown from the heating element into the sauna enclosure via the duct and through the louvers by the fan. The hot air combines with the sweat and becomes humid, and the water vapor in the hot air is recovered by the condenser. The condenser condenses the vapor in the hot, humid air and makes the air cool and dry. Then the cool, dry air is blown to the heating element again and continues to cycle in the sauna enclosure. The water that is condensed by the condenser flows to the tray via the tube.

19 Claims, 7 Drawing Sheets

DRY-HEAT SAUNA MACHINE

BACKGROUND OF THE INVENTION

1. Field of the Invention

The present invention relates to a sauna machine, and more particularly to a dry-heat sauna machine which can be moved from one location to another.

2. Description of Related Art

A conventional sauna machine in accordance with the prior art shown in FIGS. 5–6 comprises a frame (50) and a seat (51) mounted on the frame (50). A cloth cover (52) with a zipper (522) covers the frame (50) and contains a hole (521) through which a user's head and neck protrude. The frame (50) has a support (53) mounted thereon to support a hot vapor generator (60). The vapor generator (60) has a tank (62) to hold water, a heating element (63) in the lower portion of the tank (62), a vapor outlet (64) formed on the top of the tank (62) and a control panel (61) mounted on one end of the tank (62). The control panel (61) has an adjustment knob (611) mounted thereon to control and adjust the heating process.

The heating element (63) heats the water in the tank (62) to generate the steam vapor that is released into the sauna machine via the vapor outlet (64). The temperature of the vapor can increase the users, but blood circulation and sweating rate so as to promote the metabolism of the user. But this machine still has disadvantages as follows.

1. Stuffy and wet; the vapor in the sauna machine is very watery, and a user in the machine is sweaty which makes the person feel stuffy and wet. It is very uncomfortable.
2. Dangerous; the water level in the tank (62) will drop gradually when the heating element (63) is operating. Once the water level is lower than the heating element (63), it is very dangerous.
3. Not convenient; the adjustment knob (611) on the panel (61) is outside of the sauna machine, so it is not convenient when the user feels too cold or too hot and wants to adjust the temperature of the vapor.

The present invention has arisen to mitigate and/or obviate the disadvantages of the conventional sauna machine.

SUMMARY OF THE INVENTION

In accordance with one aspect of the present invention, a dry-heat sauna machine is provided. The dry-heat sauna machine includes a frame having a vertical portion and a horizontal portion. A cloth cover covers the frame and forms a sauna enclosure. An air-circulating device is attached to the horizontal portion of the frame and includes a condenser and a heating element attached thereto. A programmer is attached to the sidewall of the frame.

The heating element generates hot air in the sauna machine, and the condenser recovers the water vapor from the air in the sauna machine. Consequently, the user can feel dry and comfortable as the air circulates.

Further benefits and advantages of the present invention will become apparent after a careful reading of the detailed description with appropriate reference to the accompanying drawings.

DETAILED DESCRIPTION OF THE INVENTION

Figure 1:
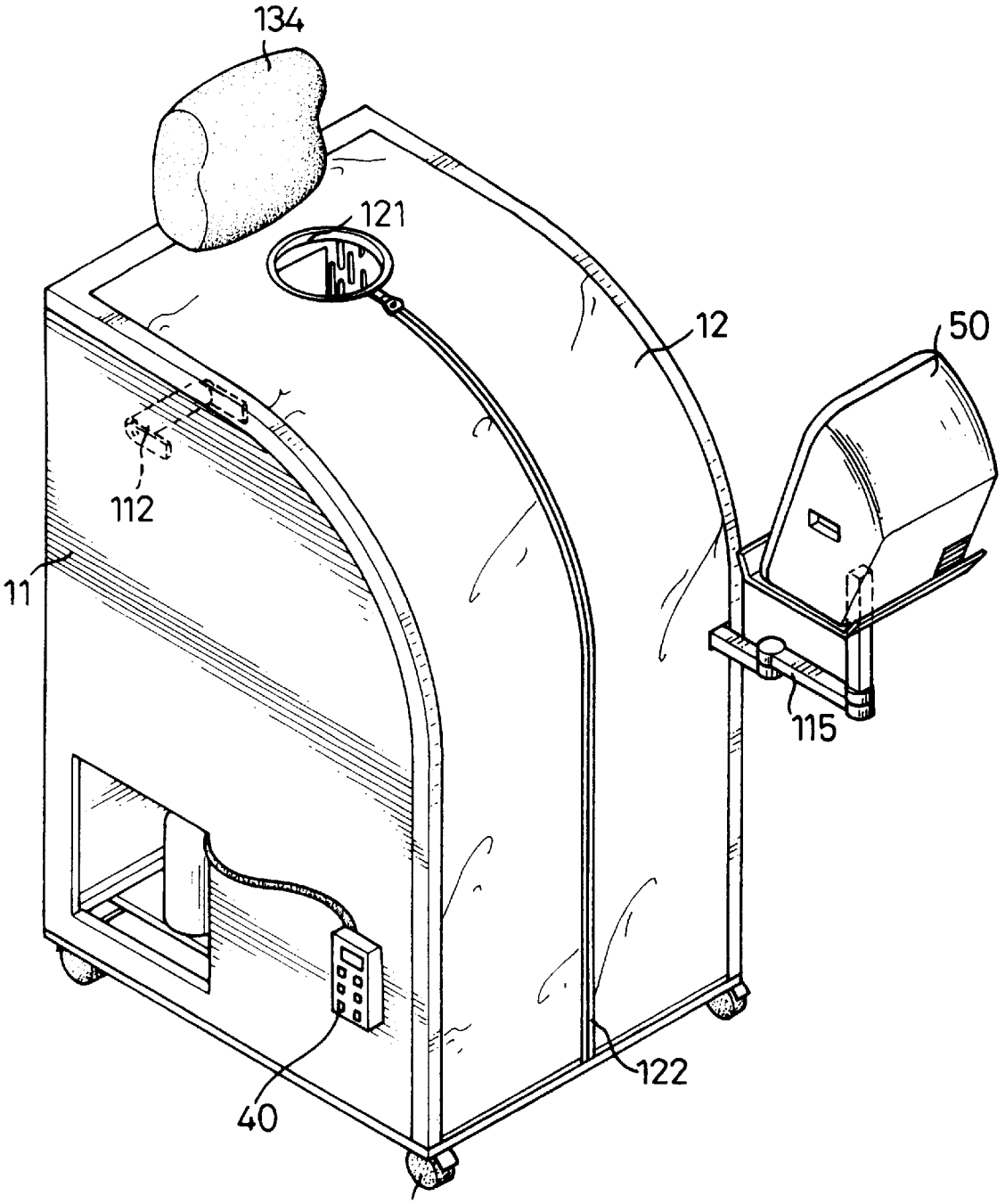
FIG. 1 is a perspective view of a dry-heat sauna machine in accordance with the present invention.
Figure 2:
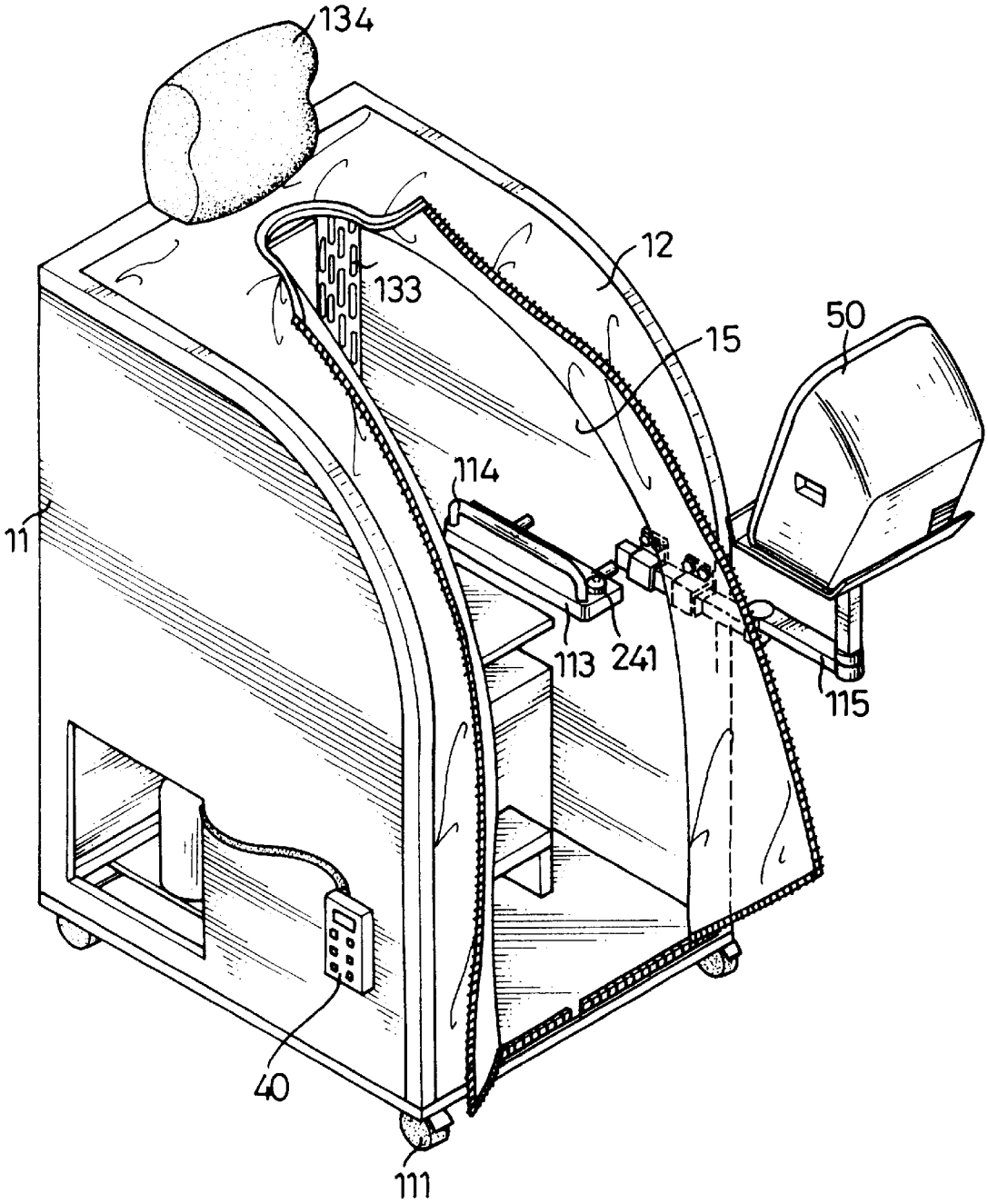
FIG. 2 is a perspective view of the dry-heat sauna machine in FIG. 1 with the cloth cover open.
Figure 3:
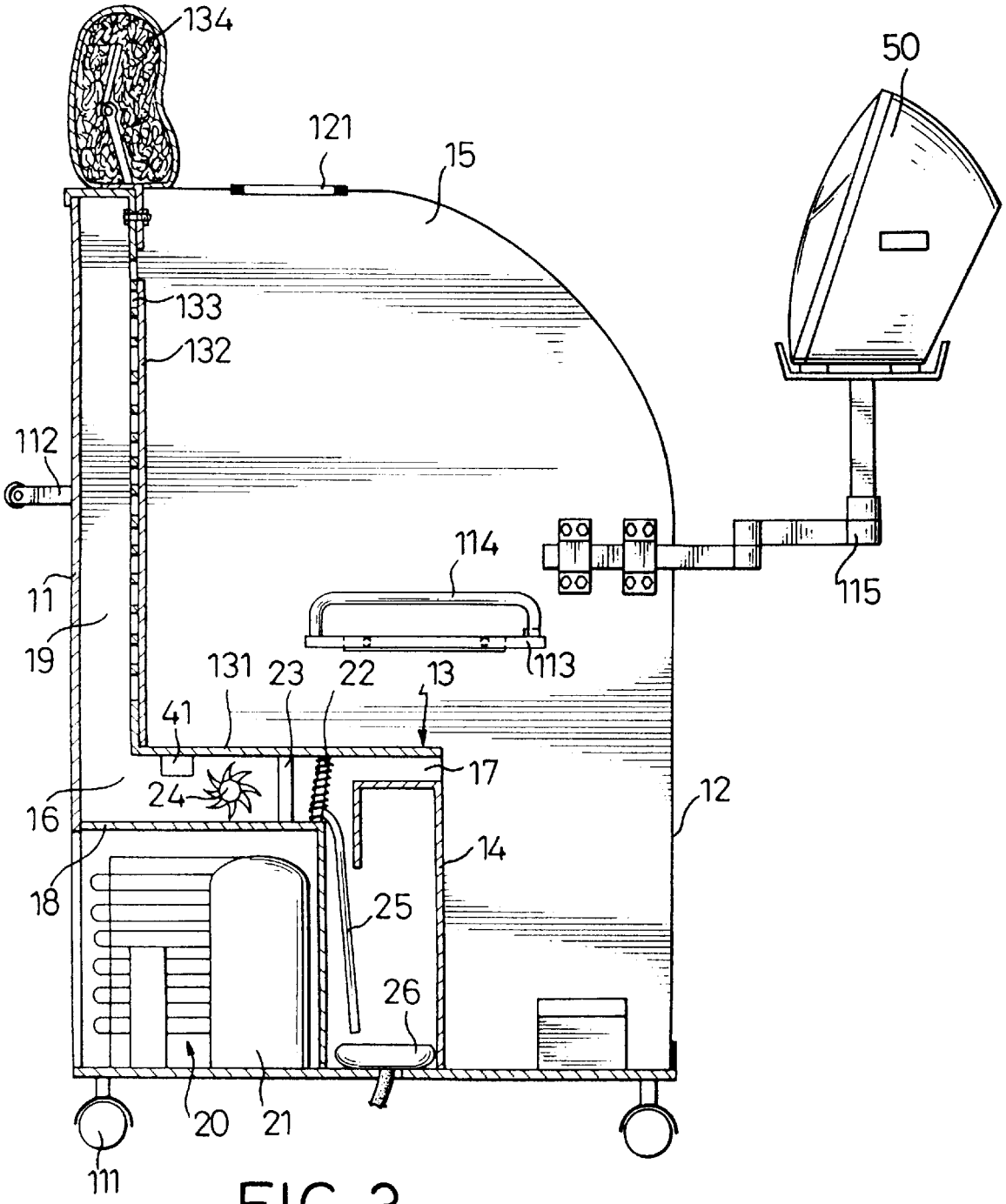
FIG. 3 a side cross-section view of the dry-heat sauna machine in FIG. 1.
Figure 4:
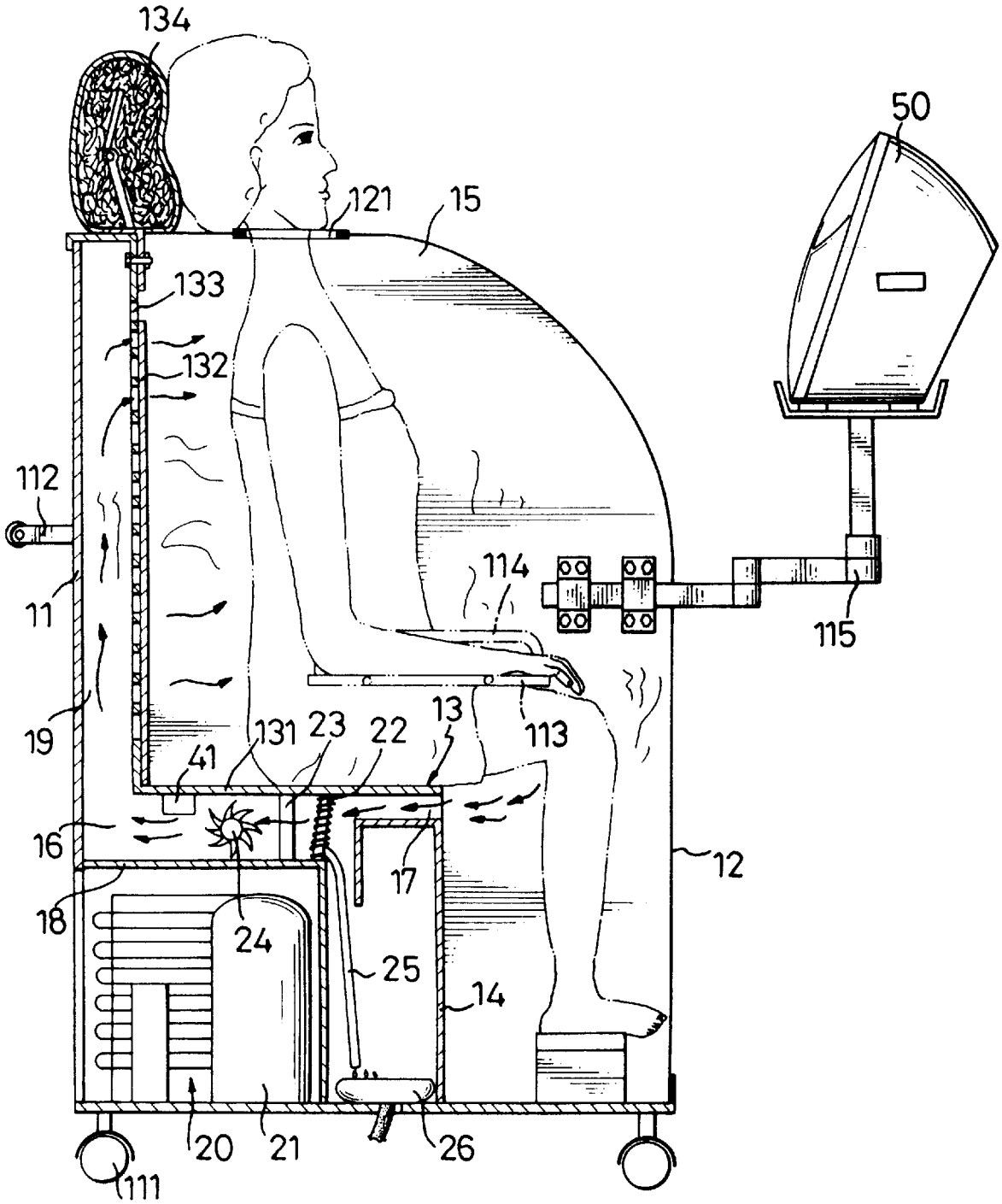
FIG. 4 is a schematic operational side cross-section view of the dry-heat sauna machine in FIG. 1.
Figure 5:
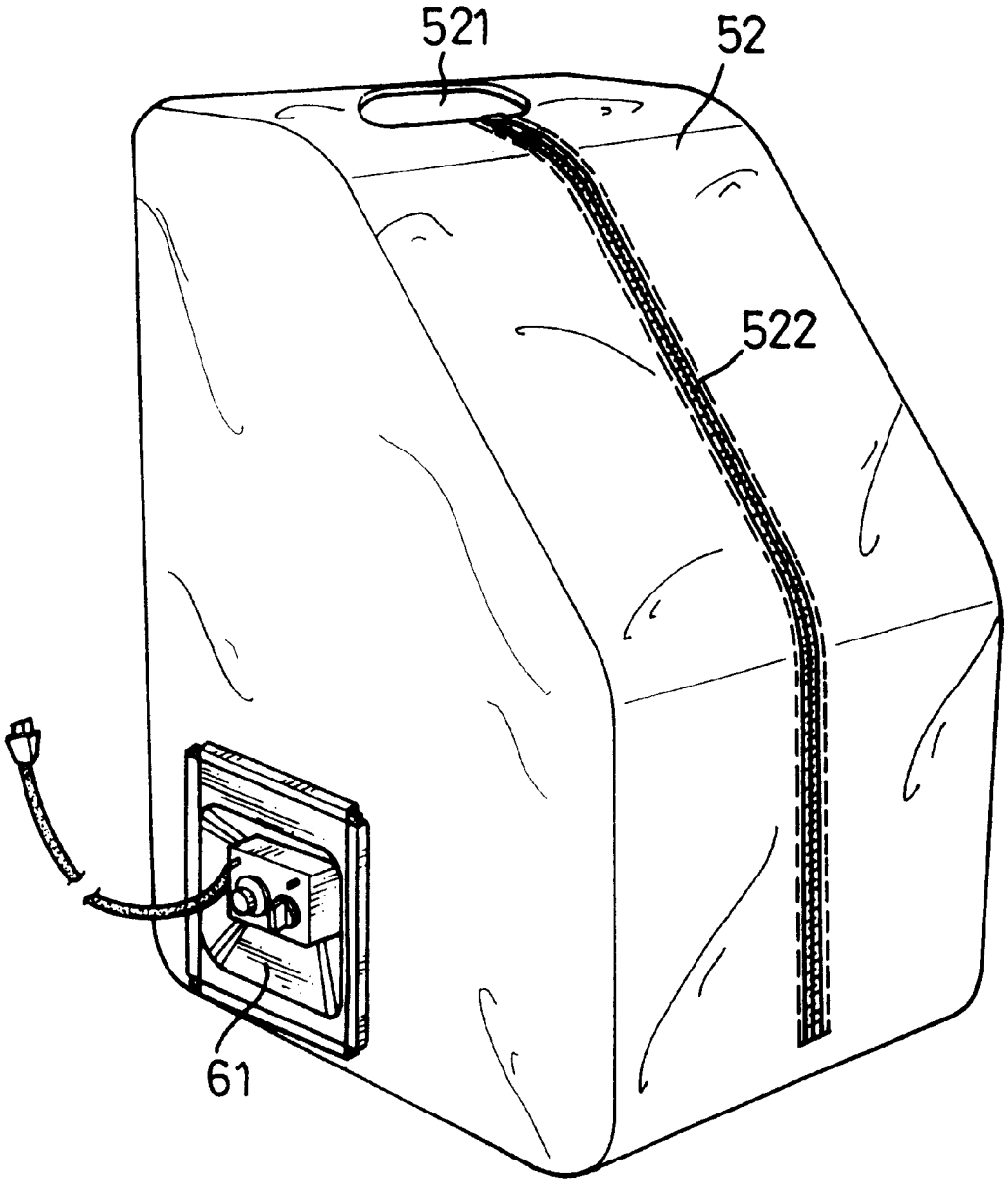
FIG. 5 PRIOR ART
FIG. 5 is a perspective view of a conventional sauna machine in accordance with the prior art.
Figure 6:
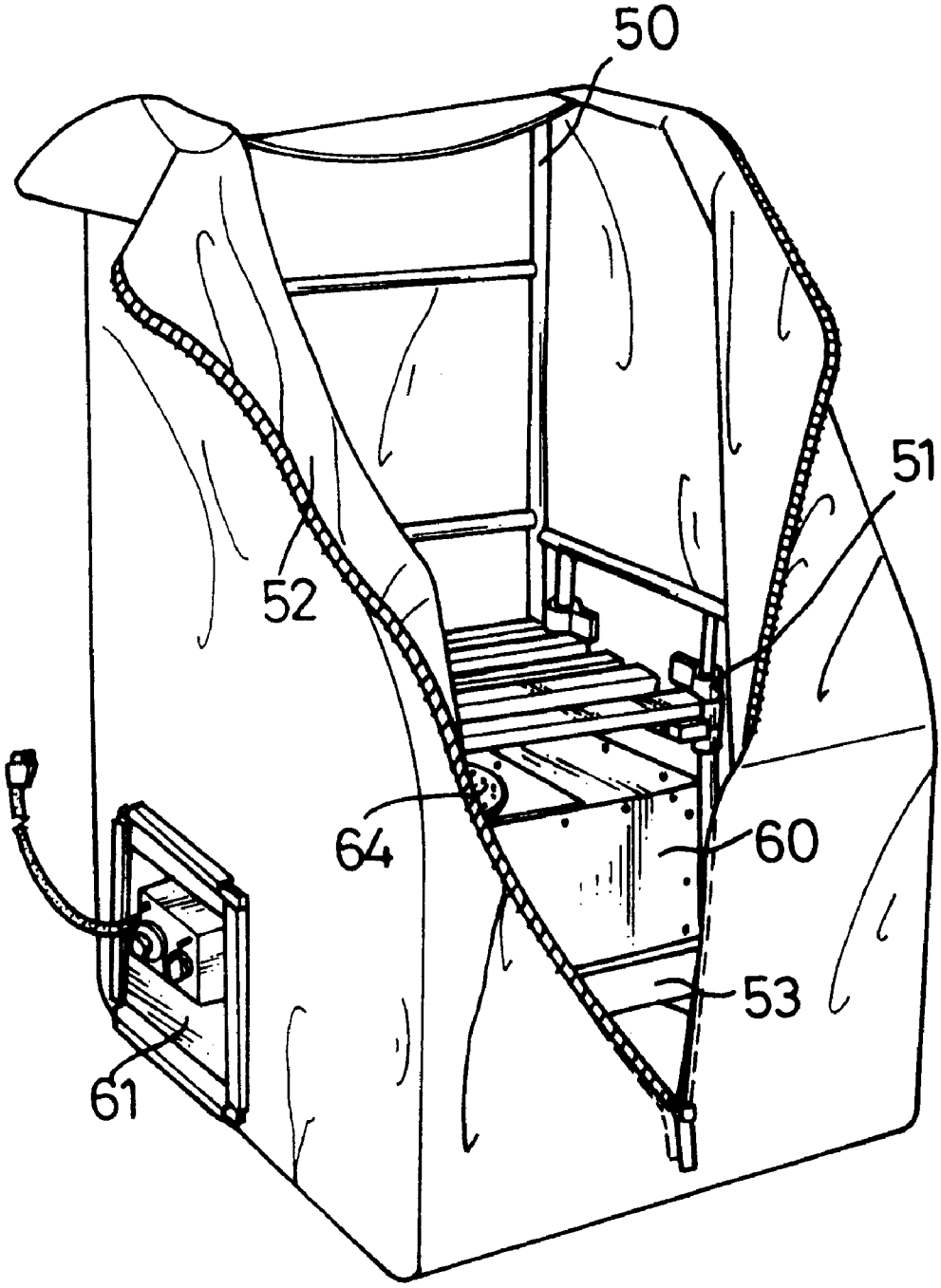
FIG. 6 PRIOR ART
FIG. 6 is a perspective view of the conventional sauna machine in FIG. 5 with the cloth cover open.
Figure 7:
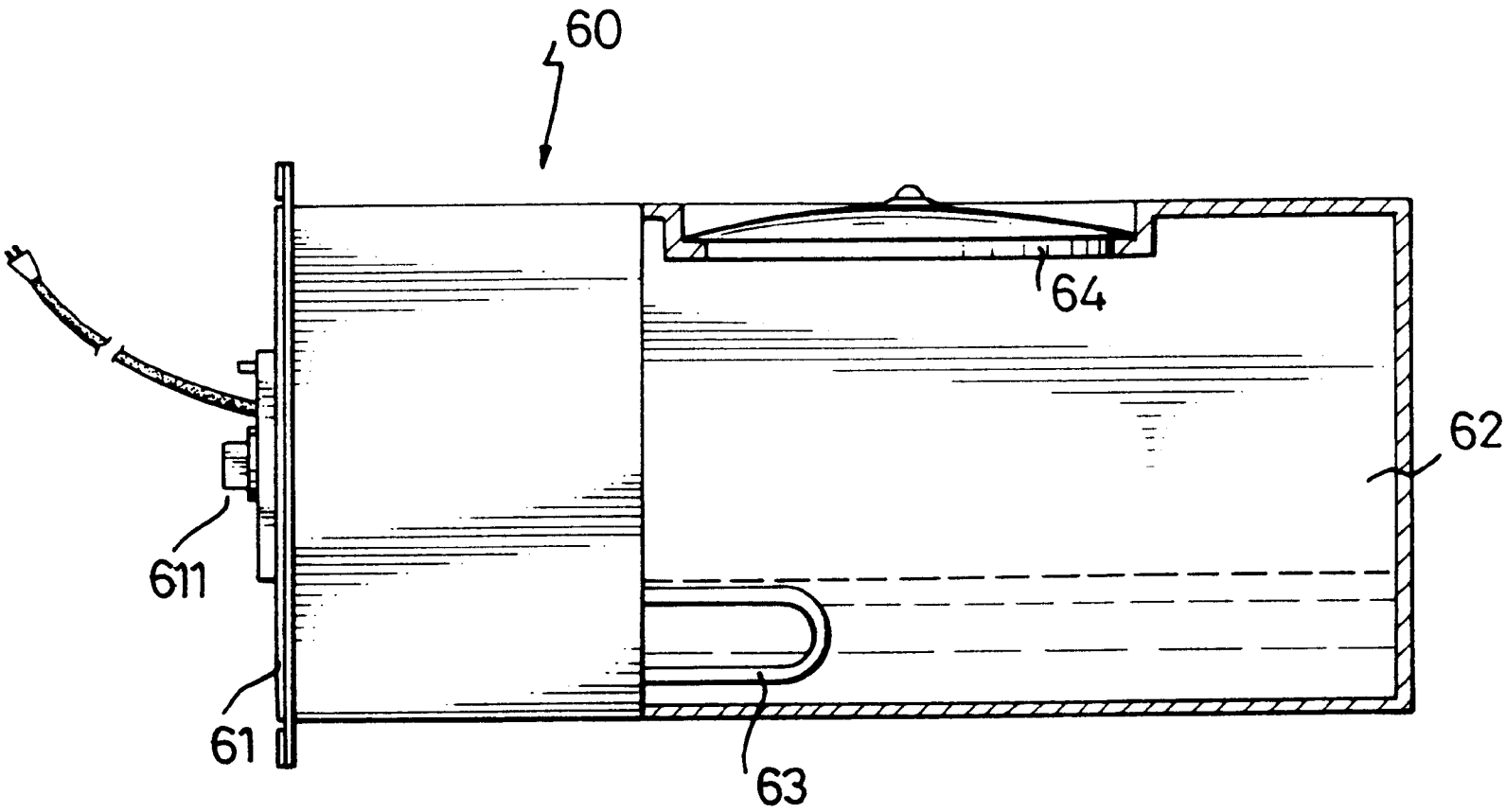
FIG. 7 PRIOR ART
FIG. 7 is a partial cross-section view of the tank and heating element of the conventional sauna machine in FIG. 5.

Referring to the drawings and initially to FIGS. 1–3, a dry-heat sauna machine in accordance with the present invention comprises a frame (11) having a horizontal portion and a vertical portion. A cloth cover (12) covers the frame (11) to form a sauna enclosure (15). An air-circulating device (20) is attached to the bottom of the frame (11). A programmer (40) is attached to the sidewall of the frame (11). The frame (11) includes rollers (11 1) attached to the horizontal portion of the frame and a handlebar (112) mounted on the vertical portion of the frame (11) to make moving the machine easier. The frame (11) also includes two sidewalls each having an interior arm (113) which has a handle (114) attached thereto to make people feel more comfortable while using the dry-heat sauna machine.

A seat (13) is connected to the two sides of the frame (11). An L-shaped plate (14) is attached to the horizontal portion of the frame (11) to define a passage (17) below the seat (13). A zipper (122) is sewn on the cloth cover (12) to close the cloth cover. The seat (13) includes a seat plate (131) and a backrest (132) abutting each other. The backrest (132) contains multiple louvers (133) and defines a duct (19) between the vertical portion of the frame (11) and the backrest (132). The seat (13) includes a pillow (134) attached to said backrest (132) of said seat (13).

The air-circulating device (20) includes a compressor (21) attached to the horizontal portion of the frame (11) and a partition (18) covering the compressor (21) to define a control chamber (16) between the seat (13) and the partition (18). A condenser (22), a heating element (23) and a fan (24) are all attached to the partition (18) and received in the control chamber (16). A drain tube (25) is mounted on the condenser (22), and a tray (26) is attached to the horizontal portion of the frame (11) to collect the water from the condenser (22) via the drain tube (25). An adjustment knob (241) is attached to the arm (113) to control the speed of said fan (24). A sensor (41) is attached to the seat plate (131) in the control chamber (16) to prevent the sauna machine from overheating. A pivotal linkage (1 15) is attached to the sidewall ofthe frame ( 11) to support a TV set (50) thereon.

When the dry-heat sauna machine is operating, the user sits on the seat (13) with his head protruding out of the sauna machine via a hole (121) in the cloth cover (12) formed when the zipper (122) in the cloth cover (12) is closed. The hot air is blown into the sauna enclosure (15) from the heating element (23) via the duct (19) and through the louvers (133) by the fan (24). The hot air combines with the sweat and becomes humid, and the water vapor is recovered from the hot air by the condenser (22) to make the air cool and dry. Then the cool, dry air is blown to the heating element again and continues to cycle in the sauna enclosure (15). The water which is condensed by the condenser (22) flows to the tray (26) via the tube (25).

Although the invention has been explained in relation to its preferred embodiment, it is to be understood that many other possible modifications and variations can be made without departing from the spirit and scope of the invention as hereinafter claimed.

What is claimed is:

1. A dry-heat sauna machine comprising in combination:

a frame (11) including a vertical portion and a horizontal portion;

a cloth cover (12) covering said frame (11) to form a sauna enclosure (15); and an air-circulating device (20) attached inside said enclosure (15) for circulating the air inside said enclosure (15) and including a compressor (21) attached to said horizontal portion of said frame (11) and a partition (18) covering said compressor (21) to form a control chamber (16) therein.

2. The dry-heat sauna machine in accordance with claim 1, wherein said frame (11) includes rollers (111) attached to the underside of said horizontal portion and a handlebar (112) attached to said vertical portion of said frame (11).

3. The dry-heat sauna machine in accordance with claim 1, wherein said cloth cover (12) includes a zipper (122) sewn thereon to form a hole (121) for receiving a person's neck.

4. The dry-heat sauna machine in accordance with claim 1, wherein said frame (11) includes two sidewalls each having an arm (113), said arm (113) having a handle (114) attached thereto.

5. The dry-heat sauna machine in accordance with claim 1, wherein said frame (11) includes a seat (13) inside said sauna enclosure (15).

6. The dry-heat sauna machine in accordance with claim 5, wherein said seat (13) includes a horizontal seat plate (131) and a vertical backrest (132), said backrest (132) extending from said seat plate (131) and containing multiple louvers (133) therein, and a duct (19) being defined between said vertical portion of said frame (11) and backrest (132).

7. The dry-heat sauna machine in accordance with claim 5, wherein said seat (13) includes a pillow (134) attached to said backrest (132) of said seat (13).

8. The dry-heat sauna machine in accordance with claim 6, wherein said frame (11) includes a plate (14) attached to said horizontal portion and defines a passage (17) between said seat plate (131) and said plate (14) to allow the humid air to flow back to said air-circulating device (20).

9. The dry-heating sauna machine in accordance with claim 1, wherein said air-circulating device (20) includes a condenser (22), a heating element (23) and a fan (24) each attached to said partition (18) and received in said control chamber (16).

10. The dry-heat sauna machine in accordance with claim 9, wherein said condenser (22) includes a drain tube (25) mounted thereon and a tray (26) attached to said horizontal portion of said frame (11).

11. The dry-heat sauna machine in accordance with claim 9, wherein said fan (24) includes an adjustment knob (241) attached to said arm (113) for controlling the speed of said fan (24).

12. The dry-heat sauna machine in accordance with claim 1, wherein said frame (11) includes a sidewall and a pivotal linkage (115) attached to said sidewall thereof.

13. The dry-heat sauna machine in accordance with claim 1 further comprising a TV set (50) supported by said pivotal linkage (115) of said frame (11).

14. The dry-heat sauna machine in accordance with claim 1 further comprising, in combination: a programmer attached to said frame.

15. The dry-heat sauna machine in accordance with claim 14, wherein said programmer (40) includes a sensor (41) received in said control chamber (16).

16. A dry-heat sauna machine comprising, in combination:

a frame including a horizontal portion;

a cloth cover covering said frame to form a sauna enclosure; and an air-circulating device attached inside the enclosure for circulating the air inside the enclosure, wherein said frame includes a seat inside said sauna enclosure and including a horizontal seat plate, wherein said frame includes a plate attached to said horizontal portion and defines a passage between said seat plate and said plate to allow the humid air to flow back to said air circulating device.

17. The dry-heat sauna machine in accordance with claim 16, wherein said seat further includes a vertical backrest, said backrest extending from said seat plate and containing multiple louvers therein, wherein the frame further includes a vertical portion, and wherein the dry-heat sauna machine further comprises, in combination: a duct defined between said vertical portion of said frame and said backrest.

18. The dry-heat sauna machine in accordance with claim 16, wherein said air-circulating device includes a partition defining a control chamber between said seat and said partition, wherein said air-circulating device further includes a condenser, a heating element and a fan each attached to said partition and received in said control chamber.

19. The dry-heat sauna machine in accordance with claim 18, further comprising, in combination: a programmer attached to said frame, wherein said programmer includes a sensor attached to said seat plate and received in said control chamber.

* * * * *